United States Patent [19]

Jones

[11] 3,931,901

[45] Jan. 13, 1976

[54] APPARATUS FOR DUMPING OPEN-TOPPED TRASH CONTAINERS

[75] Inventor: Norman E. Jones, Saratoga, Calif.

[73] Assignee: Peabody Galion Corporation, Galion, Ohio

[22] Filed: Dec. 16, 1974

[21] Appl. No.: 532,909

[52] U.S. Cl. ..... 214/302; 214/313; 214/314

[51] Int. Cl.[2] ..... B65F 3/02

[58] Field of Search ..... 214/302, 303, 312, 313, 214/314

[56] References Cited

UNITED STATES PATENTS

| | | | |
|---|---|---|---|
| 3,148,793 | 9/1964 | Walter | 214/302 |
| 3,732,997 | 5/1973 | Reavis et al. | 214/302 |
| 3,747,785 | 7/1973 | Dahlin | 214/302 |

*Primary Examiner*—Robert J. Spar
*Assistant Examiner*—Lawrence J. Oresky
*Attorney, Agent, or Firm*—Henry K. Leonard; David H. Wilson; William J. Clemens

[57] ABSTRACT

An apparatus for dumping refuse containers having outwardly extending co-axial trunnions at their upper front corners. The apparatus consists of two laterally spaced, co-acting mechanisms between which the container is located for dumping. Each of the two mechanisms has a vertically movable lever, both of the levers being pivoted on a common horizontal pivot line on a structure that remains stationary while a container is being dumped. The lower ends of the levers are connected by a cross member which engages the container at a level beneath the trunnions. Each of the mechanisms also has opposed trunnion locks which are moved by a hydraulic cylinder to engage the trunnions. Thereafter, through a lost motion connection, the levers and cross member are swung rearwardly and upwardly by the hydraulic cylinders in order to tip the container over for dumping the refuse. Stop members are automatically moved into position for preventing the container from tipping over beyond inverted position while it is being dumped.

13 Claims, 13 Drawing Figures

FIG. 10
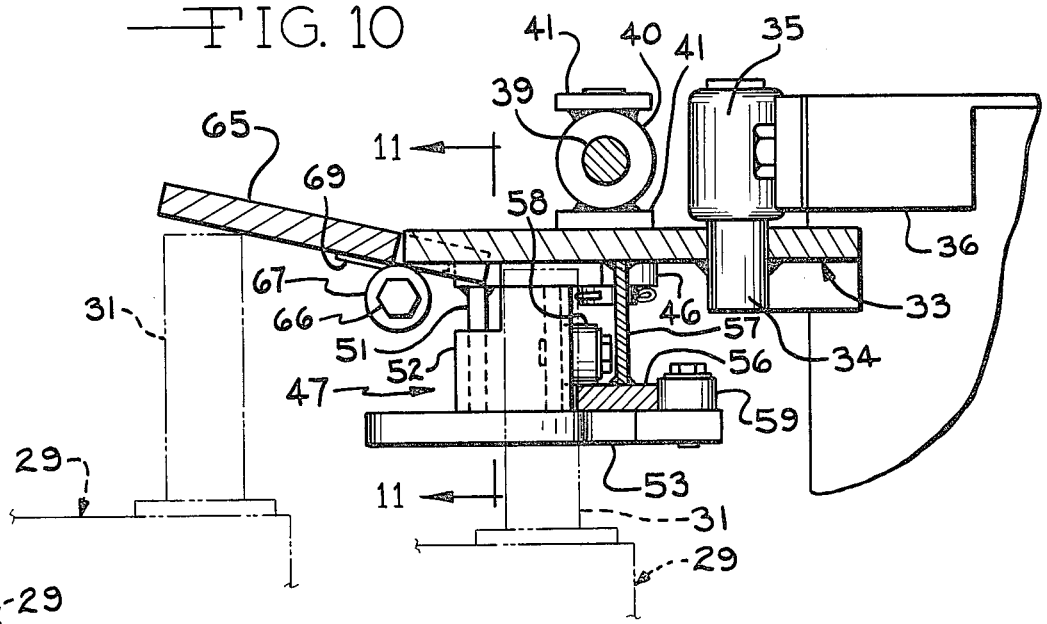
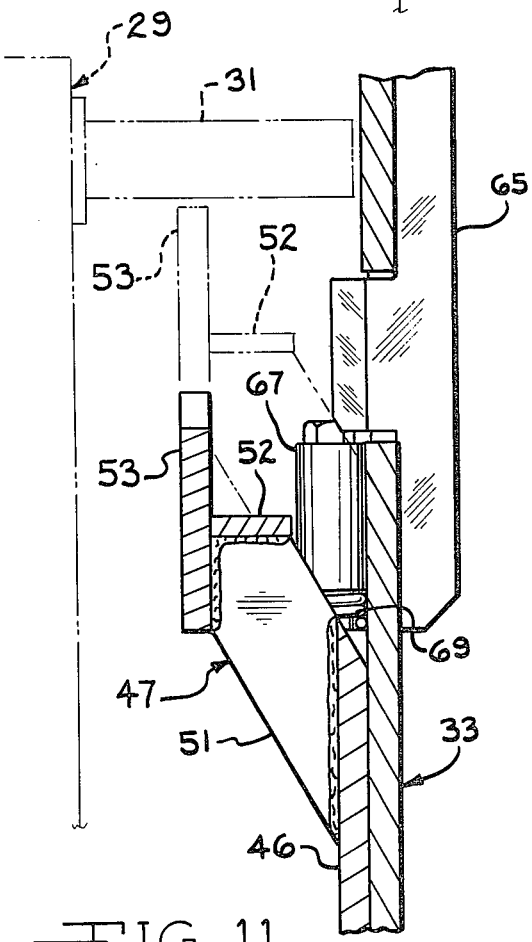
FIG. 11
FIG. 12
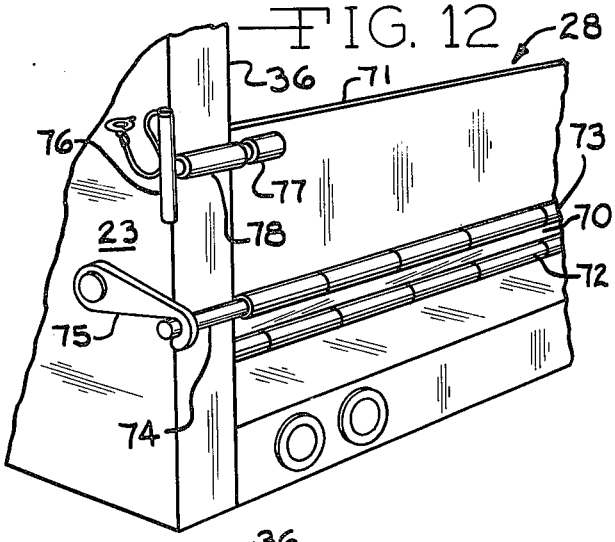
FIG. 13
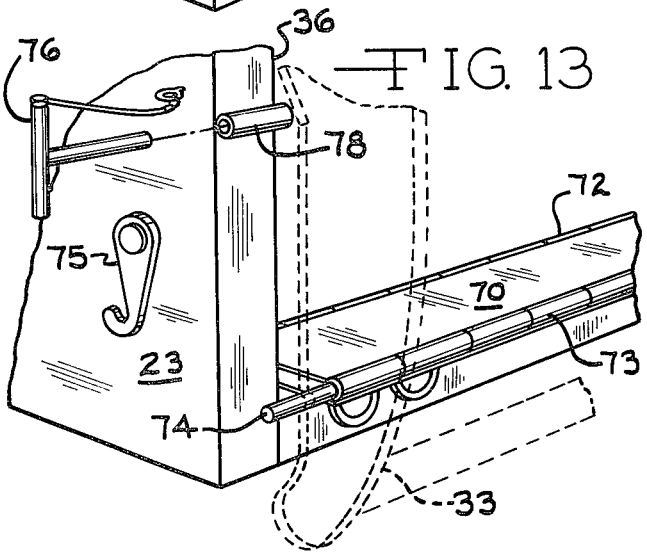

APPARATUS FOR DUMPING OPEN-TOPPED TRASH CONTAINERS

BACKGROUND OF THE INVENTION

Refuse containers of the type used in households are relatively light in weight and easily can be handled by operators for emptying them into refuse collection trucks. However, containers such as those used by industries, stores and apartment houses often have capacities in the order of 1 or 2 cubic yards and are much too heavy to be lifted and turned over by an operator for dumping them. Containers of this type are open-topped boxes usually having casters so that they can be pushed into place and usually they are equipped with oppositely extending trunnions at the upper corners of their front sides. Apparatus for emptying containers of this type is shown in various patents, such as Gollnick U.S. Pat. No. 2,928,562 and McCarthy U.S. Pat. No. 3,032,216. Apparatus embodying the instant invention is designed for the purpose of emptying large containers of this general type either into a refuse truck or, for another example, into the receiving hopper of a stationary refuse compacting machine in which the refuse is densified prior to loading it into a refuse truck.

In order to empty containers of this type it is necessary that the apparatus have mechanisms which are engageable with the container trunnions after an operator rolls the container into place and that the mechanisms have elements which will engage the container to turn it over so that the refuse in the container can be emptied into the receiver of the truck or the other apparatus. In addition, an apparatus designed to handle these massive containers must be of relatively heavy construction and it should have means for preventing the container from tipping or falling over beyond its inverted position into the hopper or apparatus into which its contents are being emptied. Such an apparatus preferably should also have means for automatically "squaring-up" a container as it is moved into place in order to avoid repeated attempts by an operator to precisely position it relative to the dumping apparatus and for preventing spillage of the refuse from the containers during dumping.

It is, therefore, the principal object of the instant invention to provide an apparatus for dumping refuse from open-topped refuse containers which comprises means for grasping the trunnions of such container, for engaging the container in order to turn it over, for elevating and inverting the container in order to empty its contents into a receiving hopper or other apparatus, and which has means for preventing the container from falling over into the receiver while it is being dumped.

BRIEF DESCRIPTION OF THE DRAWING

FIG. 10 is a greatly enlarged, horizontal, sectional view taken along the line 10—10 of FIG. 2;

FIG. 11 is a fragmentary, vertical sectional view taken along the line 11—11 of FIG. 10;

FIG. 12 is a fragmentary, rear quarter view in prospective of a refuse truck, with the dumping apparatus embodying the invention removed, and illustrating how a collapsible back wall for the hopper of such a truck appears in its erected position; and FIG. 13 is a view similar to FIG. 12 illustrating how the back wall may be collapsed and then retained in its collapsed position by apparatus embodying the invention.

DESCRIPTION OF PREFERRED EMBODIMENT

Figure 1:
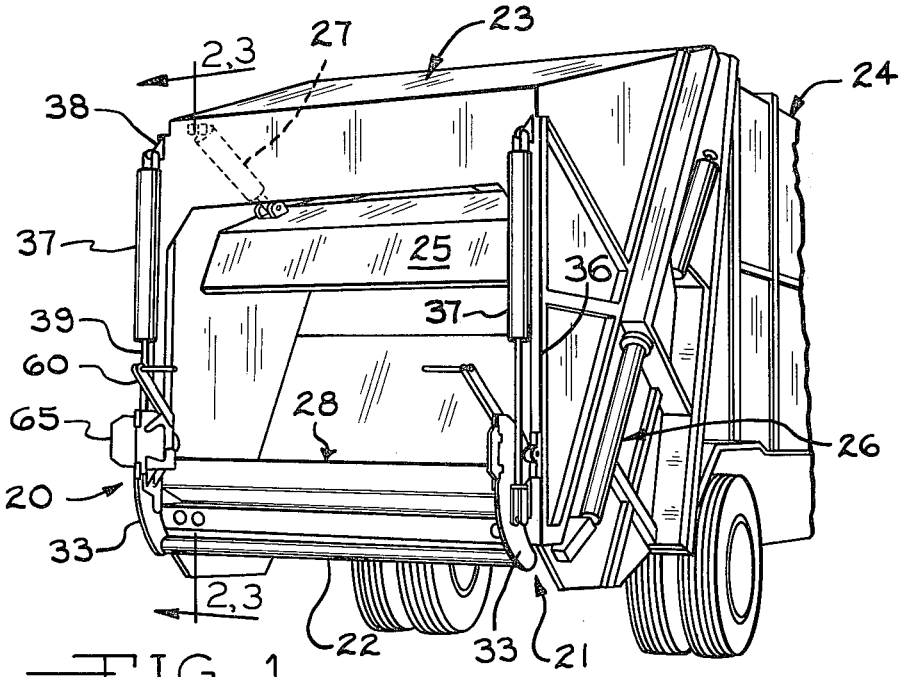
FIG. 1 is a fragmentary, rear quarter-view in perspective of a rear loader refuse truck equipped with an apparatus embodying the invention.

An apparatus embodying the invention consists of two laterally spaced mechanisms generally indicated by the reference number 20 and 21 which are connected to each other by a cross arm 22. In FIG. 1 the mechanisms 20 and 21 are shown as being mounted in vertical position on the opposite sides of a loading hopper 23 of a rear loader refuse truck, fragmentarily illustrated and indicated generally by the reference number 24. The loading hopper 23 has an internal packer blade 25, the blade 25 actuated by external hydraulic cylinders 26 and internally located hydraulic cylinders 27. The hopper 23 has a rear wall 28 which defines a bottom pocket in the hopper 23 into which refuse is emptied from individual refuse containers. By sequential actuation of the hydraulic cylinders 26 and 27 the packer blade 25 is moved through an excursion which transfers refuse out of the hopper 23 and packs it forwardly into the body of the truck 24.

An apparatus embodying the instant invention is designed for the purpose of emptying open-topped containers, such as the container 29 shown in phantom in the drawings. Such a container usually is provided with castors 30 by means of which the container may be moved from place to place and into position for emptying so that its oppositely extending co-axial trunnions 31 can be engaged by the dumping apparatus. The container may also have a lid 32 pivoted at the upper edge of its rear wall, as illustrated.

In other installations an apparatus embodying the invention may be positioned on upright posts or pillars located adjacent the loading hopper of a stationary compacting machine or at the edge of a loading dock. In the latter position the containers would be emptied into an open-topped truck or into other vehicles for transporting the refuse to other locations.

Because the two mechanisms 20 and 21 are identical except for their reversed position, i.e., one being "left hand" and the other being "right hand, " the following description will relate to the mechanism generally indicated by the reference number 20 which is shown as being mounted at the left side of the hopper 23.

Figure 6:
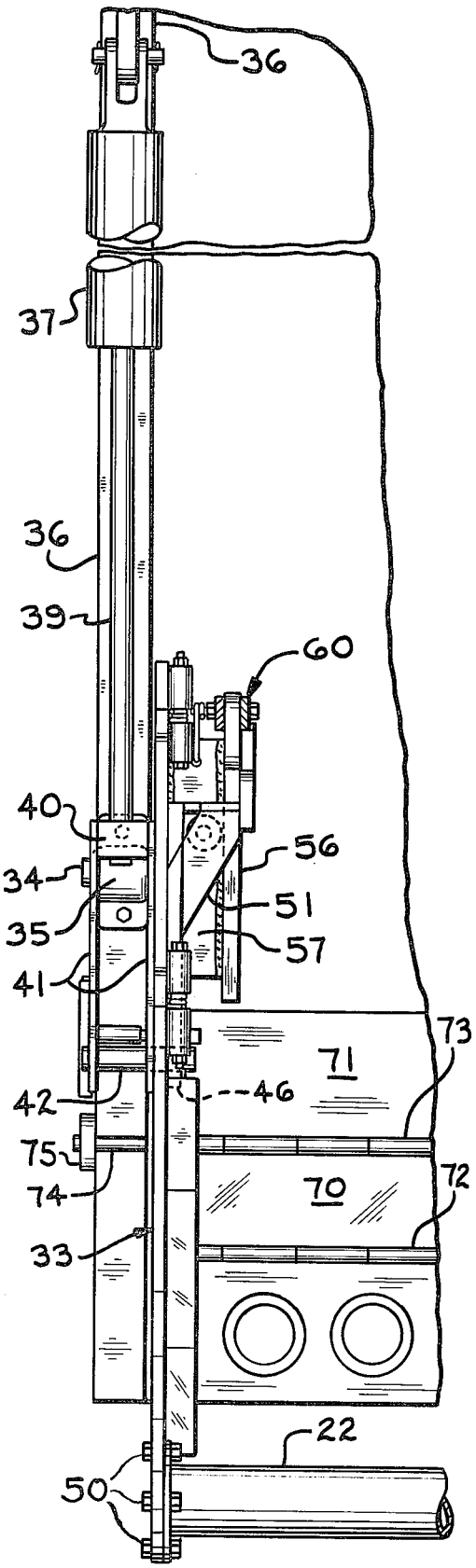
FIG. 6 is a view similar to FIG. 5 but taken from the position indicated by the line 6—6 of FIG. 3.
Figure 9:
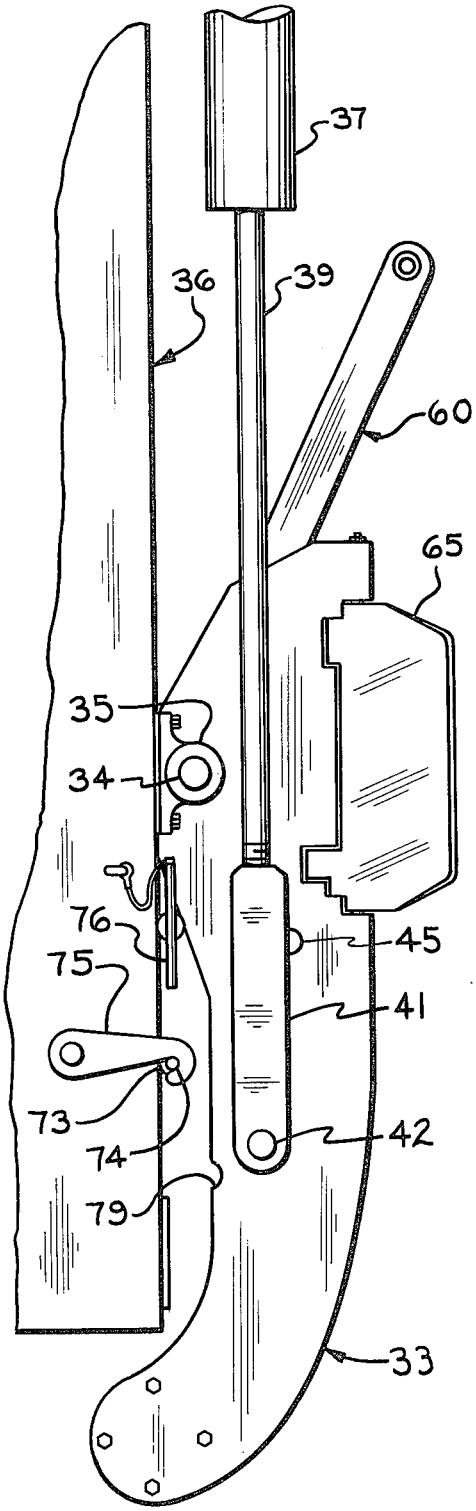
FIG. 9 is a fragmentary view in side elevation taken from the position indicated by the line 9—9 of FIG. 5.

Each of the mechanisms 20 or 21 has a main lever 33 which is mounted by a heavy pivot shaft 34 (see FIG. 10) in a bearing 35. The two bearings 35 are rigidly mounted on the respective ones of uprights 36 which form the side frame members for the hopper 23. An actuating cylinder 37 is pivotally connected at its upper end to a bracket 38, the bracket 38 being in turn mounted near the top of the upright 36. A cylinder rod 37 (see FIGS. 6 and 9) is pivotally connected at its lower end to a collar 40 which is welded between and to a pair of parallel, downwardly extending bars 41. A pin 42 carried by the bars 41 extends through a slot 43 in the main lever 33. The slot 43 has a longer branch 44 which extends vertically when the mechanism is at rest or during initial engagement with the trunnion 31 (see FIGS. 2–4). The slot 43 also has a shorter, rearwardly extending branch 45 at its upper end. The pin 42 also extends through a hole in a lower arm 46 of a lower, movable trunnion jaw 47. A cotter 48 retains the pin 42 in position.

The cross-arm 22 has a collar 49 welded in place at each of its ends and the collars 49 are secured to the lower ends of the main levers 33 by bolts 50. (See FIG. 6)

The lower trunnion jaw 47 also comprises a pair of angularly extending buttress plates 51 which are welded to the innerside of its lower arm 46 and on the upper ends of which there is welded a bracing plate 52, the plate 52 having welded to it a jaw plate 53.

An upper trunnion jaw 54 (FIG. 4) comprises a rearwardly extending hook 55 and a downwardly extending guidebar portion 56. The upper trunnion jaw 54 is mounted on the innerside of the main lever 33 by a spacer 57 to which it is welded. Vertical movement of the lower trunnion jaw 47 relative to the lever 33 and the upper trunnion jaw 54 is guided by the engagement of the portion 56 with a pair of guide rollers 58 and 59, the rollers 58 and 59 being mounted, respectively, on one of the buttress plates 51 and the jaw plate 53.

Figure 2:
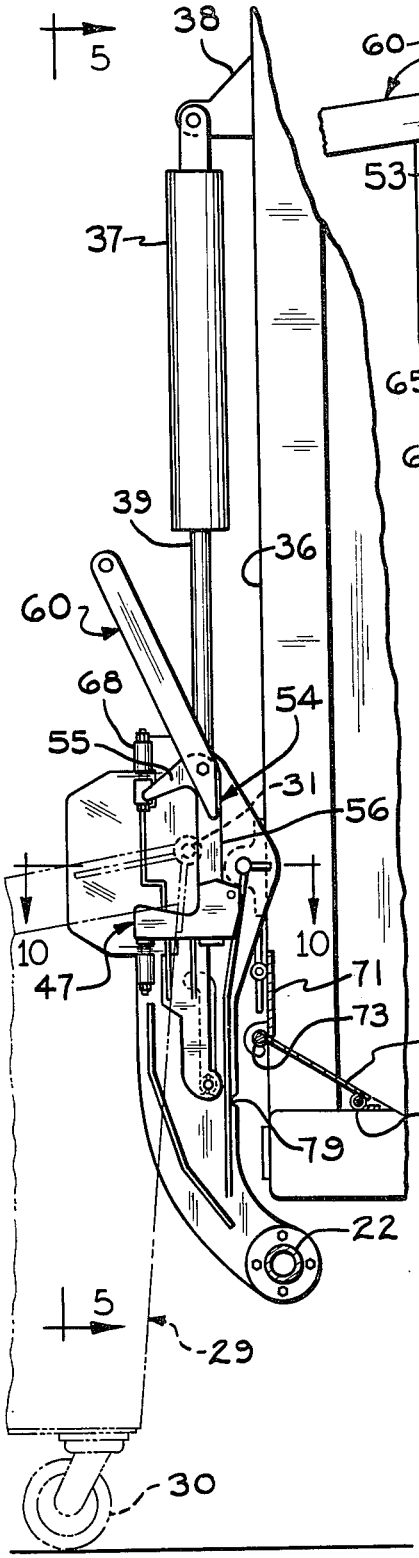
FIG. 2 is an enlarged, fragmentary, vertical sectional view taken approximately from the position indicated by the line 2,3—2,3 of FIG. 1, and showing the apparatus in rest or initial position ready to engage the trunnions of a container to be emptied.
Figure 4:
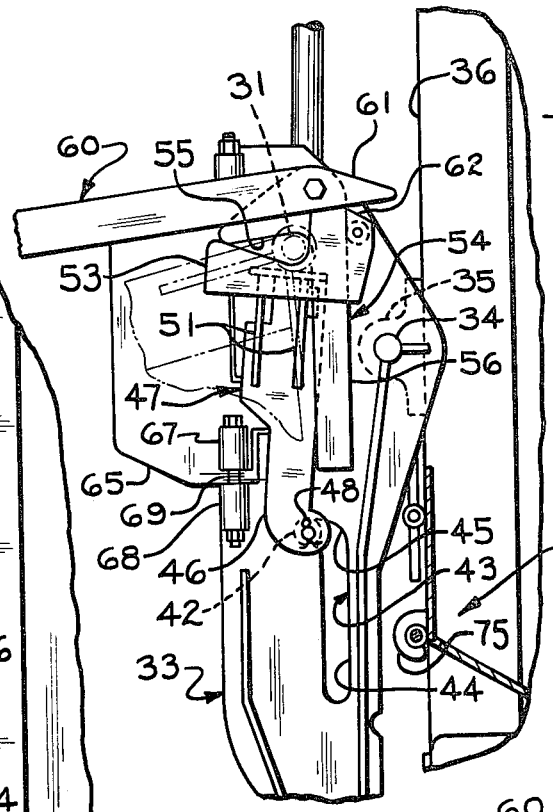
FIG. 4 is a fragmentary enlarged view of a portion of the apparatus shown in FIG. 3 and illustrating the apparatus in a position immediately following that shown in FIG. 3.
Figure 3:
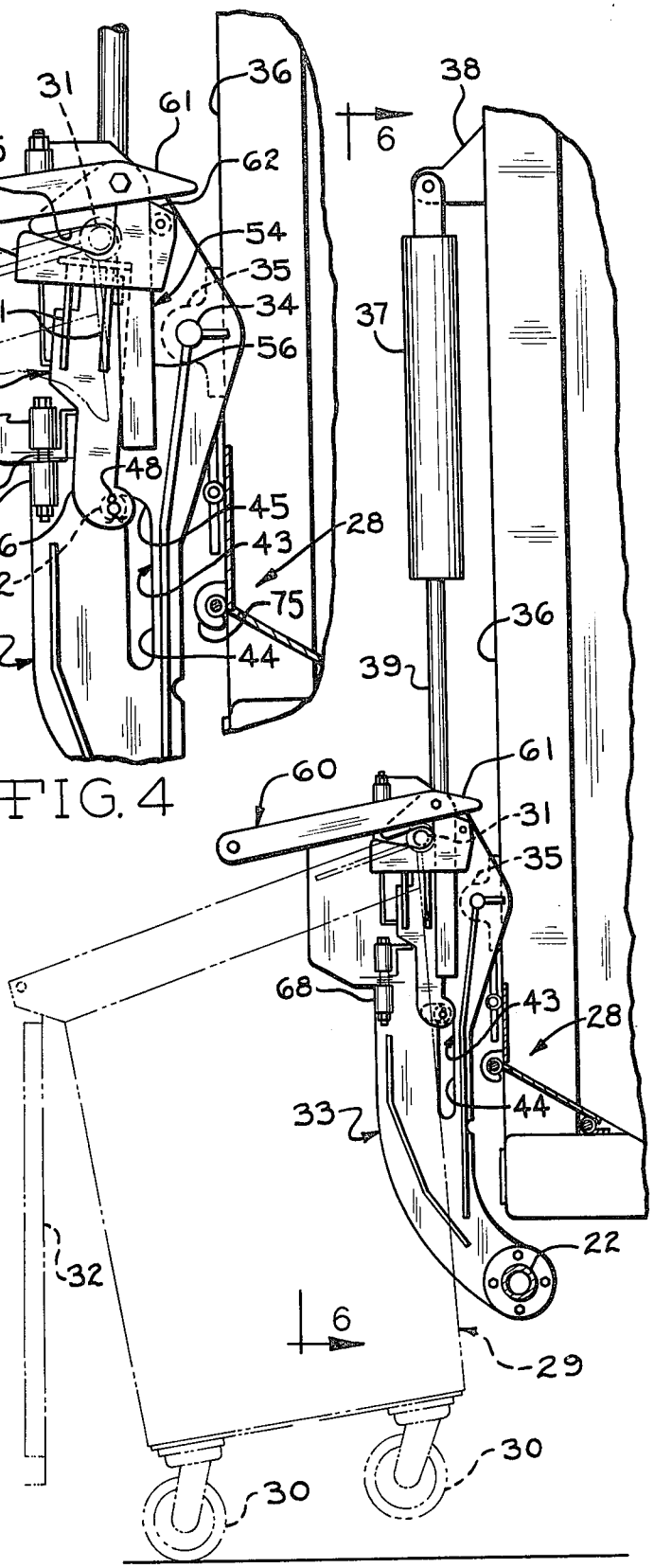
FIG. 3 is a view similar to FIG. 2, also taken along the line 2,3—2,3 and showing a container in phantom immediately after it is first engaged by apparatus embodying the invention.

By reason of the fact that the pin 42 extends through the slot 43 in the lever 33, when the cylinder 37 is actuated to retract its rod 39, moving the rod 39 and the mechanism connected thereto from the position illustrated in FIG. 2 through the position illustrated in FIG. 3 and to the position illustrated in FIG. 4, the "lost motion" connection thus provided results in the lower trunnion jaw 47 being moved vertically relative to its main lever 33 without causing the main lever 33 to be pivoted around its pivot shaft 34, as can best be seen by reference to FIG. 3. When the connecting pin 42 reaches the top of the longer branch 44 of the slot 43, the lower trunnion jaw 47 has been moved upwardly a distance sufficient so that it engages the respective one of the container trunnions 31.

Figure 8:
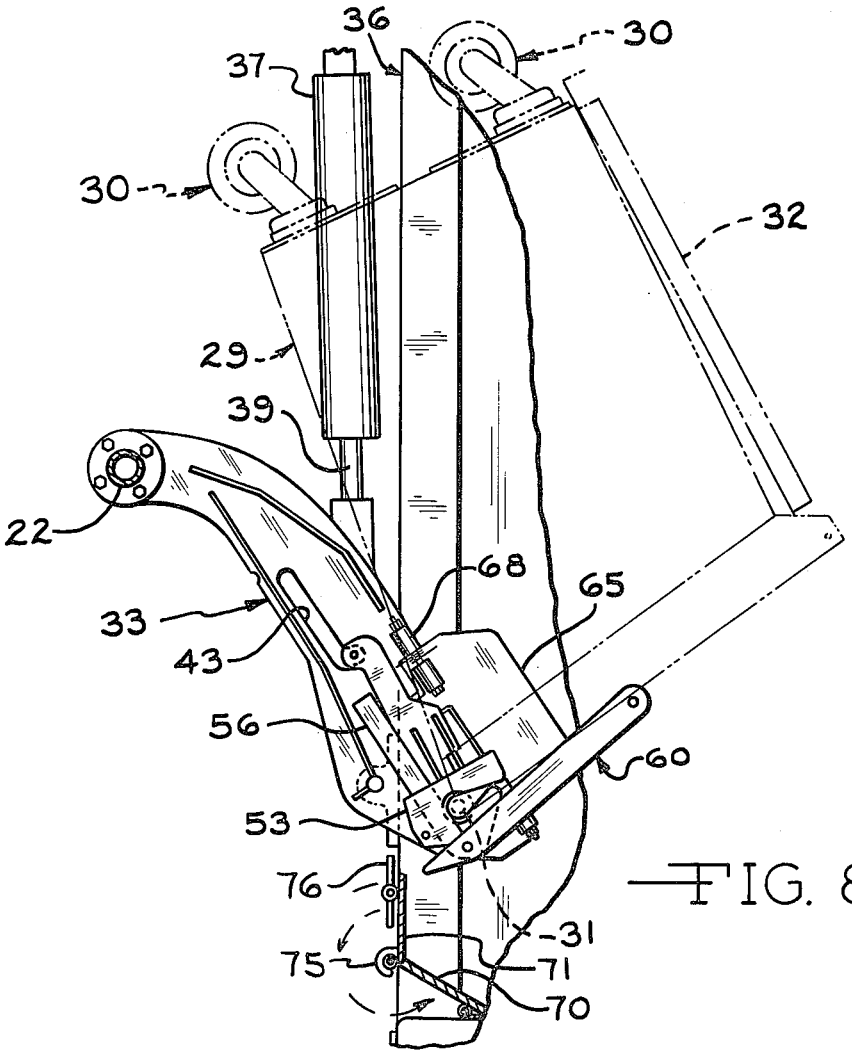
FIG. 8 is a view similar to FIG. 7 and illustrating how the inverted container is prevented from falling over into the receiver into which its contents is being emptied by an apparatus embodying the invention.
Figure 5:
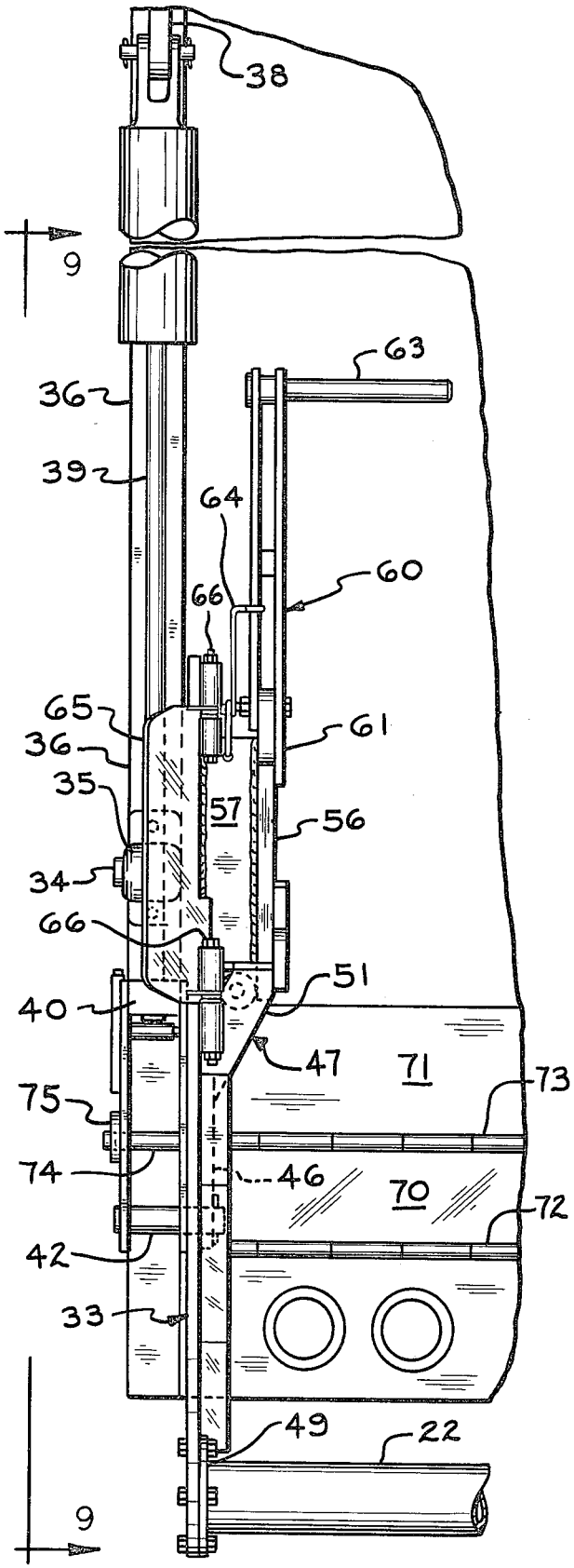
FIG. 5 is a fragmentary view in elevation taken from the position indicated by the line 5—5 of FIG. 2.

Slightly prior to the lower trunnion jaw 47 reaching the position of FIG. 3, a catch bar 60, which is pivotally mounted on the upper end of the stationary trunnion jaw 54, is engaged by the jaw plate 53. The catch bar 60 has a tapered nose 61 aligned with an angular surface 62 on the jaw plate 53 so that the catch bar 60 is swung downwardly and backwardly from the position illustrated in FIG. 2 to the position illustrated in FIG. 3. The catch bar 60 has an inwardly extending pin 63 at its upper end so that the two catch bars 60 on the mechanisms 20 and 21 and their pins cooperate to engage the upper edges of the side walls of a container 39 when it is in inverted position as illustrated in FIG. 8. Each of the catch bars 60 is resiliently urged toward its upper position (FIG. 2) by a spring 64 (FIG. 5) which is engaged between the catch bar 60 and the respective spacer 57.

Figure 7:
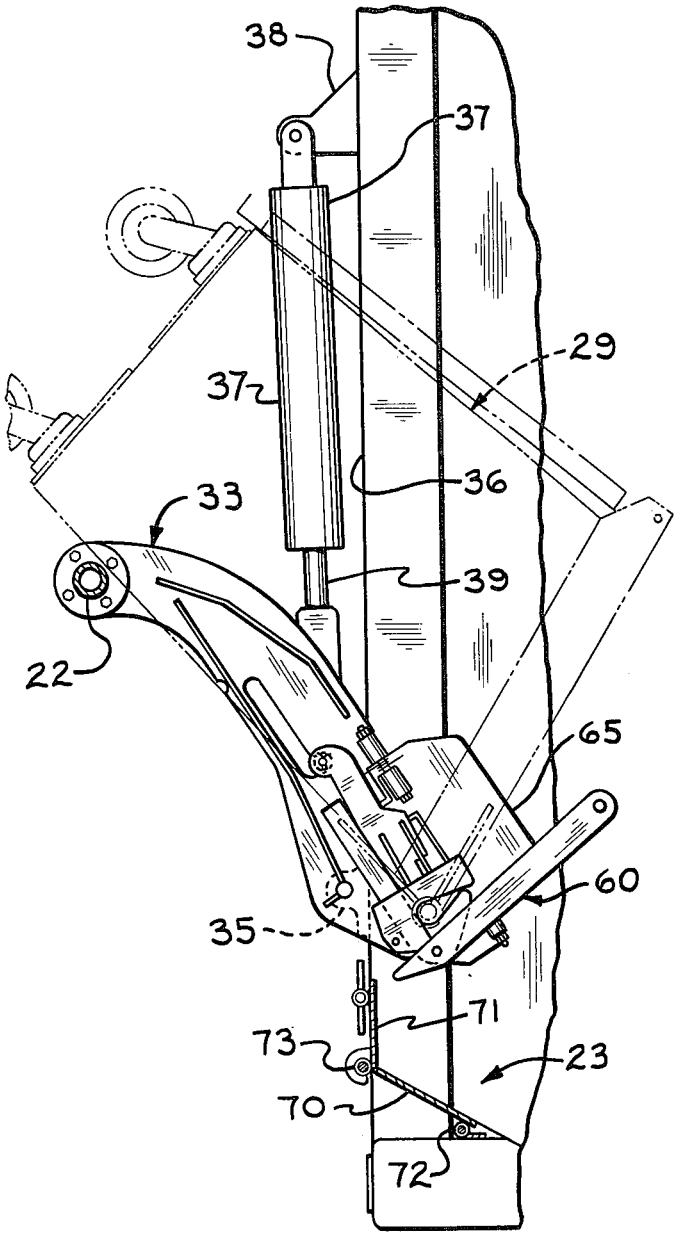
FIG. 7 is a view similar to FIGS. 2 and 3 illustrating how the container is swung upwardly to its inverted position for emptying refuse therefrom and being shown on a reduced scale relative to FIGS. 2 and 3.

When the mechanism moves from the position illustrated in FIG. 3 to the position illustrated in FIG. 4, the pin 42 travels to the end of the branch 45 of the slot 43 and engages the end of the branch 45. This rearward movement of the pin 42 tilts the lower trunnion jaw 47 so that its jaw plate 53 rocks tightly and, in cooperation with the hook 55 of the upper trunnion jaw 54, closes around the respective container trunnion 31, locking it in place. This also shifts the point of force application to the main lever 33 rearwardly relative to its pivot shaft 34 so as to provide a lever moment in order that continued retraction of the rod 39 will swing the lever 33 rearwardly and upwardly from the position illustrated in FIG. 4 to the position illustrated in FIG. 7. In this rearward movement of the lever 33, the cross arm 22 engages the front wall of a container 29 at a level substantially below the trunnions 31 and the container 29 is rotated around the pivot shaft 34 to the position shown in FIG. 7. In this position the lower corner of the container 29 is well inside the rear wall 28 so that refuse falling out of the container will fall into the hopper 23 and not spill onto the street.

In the event that the center of gravity of the container 29 and its contained refuse goes beyond a vertical projection of the pivot shaft 34, the container may overbalance. Were it not for the catch bars 60 and their pins 61, the container 29 might fall over into the interior of the hopper 23 and it would require manual action by the operators to restore it to the position illustrated in FIG. 7. In addition, the possibility that the container 29 may travel to the position of FIG. 8 has an advantage in that by moving to that position and being abruptly stopped by engagement of its top edges with the pins 61, refuse still remaining in the container 29 will be jarred loose.

After the container 29 has been emptied, the operator reverses the hydraulic connections to the cylinders 37 and they extend their rods 39. Because the position of the pins 42 in the slots 43 still is rearwardly of the main pivot shafts 34, extension of the rods 39 causes the pins 42 to move to the corners of the slots 43 and then to act against their surfaces to swing the levers 33 rearwardly and downwardly.

By reason of the engagement of the catch bar pins 63 with the upper front edges of the side walls of the container 39, the container 29 is also swung backwardly and downwardly until its center of gravity passes the vertical projection of the pivot shaft 34 and the container 29 thereafter falls backwardly against the cross arm 22 and is returned with the mechanisms 20 and 21 to the position illustrated in FIG. 3 and, eventually, to the position illustrated in FIG. 2. Thereafter the operator may wheel the empty container away from the vehicle in preparation for emptying a subsequent container.

In order to avoid the possibility that an operator might have to shift a heavy container sideways after he has attempted to move it into position for its trunnions to be grasped by the mechanisms 20 and 21, each of the mechanisms 20 and 21 has a guide wing 65 which is flared outwardly in a normal or rest position. Each of the guide wings 65 is mounted by vertically aligned pivot bolts 66 which extend through ears 67 on the wing 65 and ears 68 on the lever 33. A spring 69 is wrapped around each of the pivot bolts 66 and has arms which engage the lever 33 and wing 65 and tend to swing the wing outwardly as illustrated particularly in FIG. 10. Movement of the container 29 up to the mechanisms 20 and 21 may engage the end of one of its trunnions 31 with one of the wings 65 and this assists the operator in guiding the container into the proper position for it to be grasped and inverted.

In order to prevent refuse being emptied out of a container by the mechanisms 20 and 21 from falling downwardly and rearwardly out of the bottom of the hopper 23, hopper 23 preferably has a rear wall 28. However, in order to facilitate the emptying of smaller containers such as domestic trash cans into the bottom of the hopper, a refuse truck equipped with mechanisms 20, 21 embodying the invention preferable should have a rear wall 28 which can be collapsed during such time as it is not necessary to prevent spillage of refuse being emptied by the mechanisms 20, 21 from the larger industrial type refuse containers 29.

FIGS. 12 and 13 fragmentarily illustrate a collapsible rear hopper wall 28 which consists of two sections 70 and 71 (see also FIG. 2). The lower section 70 is pivotally connected by a piano-type hinge 72 to the floor of the hopper 23 and the section 70 is similarly pivotally connected to an upper section 71 by a second piano-type hinge 73. A hinge pin 74 of the hinge 73 extends horizontally beyond the ends of the hinge 73 and the wall sections 70–71. When the rear wall 28 is in its erected position (FIG. 12) the ends of the pin 74 are captured by retaining hooks 73 (see also FIG. 9) which are mounted on the outer sides of the side walls of the hopper 23. The upper section 71 is held in its erected position by the engagement of T-pins 76 in short sleeves 77 which are welded to the sections 71. The T-pins 76 are inserted through fixed sleeves 78 welded or otherwise secured on the uprights 36. When the T-pins 76 are removed and the hooks 75 disengaged, (FIG. 13) the rear wall 28 may be collapsed by folding the upper section 71 around and under the lower section 70 as indicated by the broken arrow in FIG. 8.

After the upper section 71 has been swung down and under the lower section 70, pivoting on the hinge 73, the two sections 70 and 71, now lying adjacent each other, are laid down, pivoting on the hinge 72 into the position illustrated in FIG. 13. In this position of two sections 70 and 71, the hinge pin 74 is engaged in notches 79 in the lower front edges of the two main levers 33 when the mechanisms 20 and 21 are in their rest position as illustrated in FIG. 2. The respective one of the levers 33 is fragmentarily shown in phantom in FIG. 13.

Having described my invention, I claim:

1. Apparatus for dumping an open-topped trash container having outwardly extending co-axial trunnions at its upper front corner, said apparatus comprising, in combination, a. two laterally spaced mechanisms mounted on a structure which remains stationary while a container is being inverted therebetween for dumping, each of said mechanisms comprising
   1. a main lever that is pivoted on said structure,
   2. opposed co-acting trunnion lock members adapted to close around one of said trunnions, 3. lost motion connecting means between one of said trunnion lock members and said lever, and
   4. an hydraulic cylinder and piston rod pivotally connected at its upper end to said structure and at its lower end to said one of said trunnion lock members and, through said lost motion connection, to said lever, and b. a cross member extending between and connected to the lower ends of said levers and adopted to engage the container at a level below the trunnions when said levers are swung upwardly relative to said structure.

2. Apparatus according to claim 1 in which the lost motion connecting means consists of a pin on the piston of the hydraulic means which is pivotally connected to a lower one of the trunnion lock members and which extends through a vertical slot in the main lever whereby vertical movement of said piston first raises said lower lock member against the container trunnion and after said pin reaches the upper end of said slot, then swings said main lever upwardly.

3. Apparatus according to claim 1 and a container catch bar on each of the main levers for preventing a container from falling over beyond inverted position.

4. Apparatus according to claim 1 in which the trunnion lock members consist of an upper downwardly and rearwardly turned hook which is fixedly mounted on the main lever and a lower upwardly movable opposed jaw which is slidably mounted on said main lever and is connected to the hydraulic piston.

5. Apparatus according to claim 1 and a rearwardly extending trunnion guide wing on the main lever positioned on the outer side of the trunnion lock members.

6. Apparatus for dumping an open-topped container having outwardly extending co-axial trunnions at its front upper corner, said apparatus comprising, in combination a. a pair of vertical, horizontally spaced, support elements that are stationary relative to the container being dumped, b. a pair of operating mechanisms, one of said mechanisms being mounted on and supported on each of said support elements, said mechanisms being identical except for their being right and left hand, respectively, each of said mechanisms comprising,
   1. a generally vertically extending main lever pivotally mounted intermediate its ends on the associated one of said support elements for backward and upward angular movement of its lower end,
   2. an upper trunnion jaw fixedly mounted on said main lever,
   3. a lower, co-operating trunnion jaw mounted on said main lever for vertical sliding movement relative thereto,
   4. hydraulic cylinder means pivotally connected at its upper end to the associated one of said support elements,
   5. a vertically extending slot in said main lever, the center line of said slot being spaced backwardly from the pivot line for said main lever, and
   6. a horizontal connecting pin mounted on the lower end of said hydraulic cylinder means and extending through said slot and into said lower trunnion jaw, and c. a cross member connected to the lower ends of said main lever for engaging the front wall of a container along a line spaced below the container trunnion and below the pivot line for said main levers.

7. Apparatus according to claim 6 in which the slot in the main lever has a rearwardly extending short branch at its upper end, so that when the pin connecting the hydraulic cylinder means to the lower trunnion jaw enters such short branch, said lower jaw is tilted relative to the main lever for closing said lower trunnion jaw around a container trunnion.

8. Apparatus according to claim 6 and a container catch bar on each of said mechanisms for preventing a container from falling over beyond inverted position.

9. Apparatus according to claim 6 and a container catch bar pivotally mounted on the upper end of the main lever and movable by the lower trunnion jaw into position overlying but spaced from the container when said lower trunnion jaw reaches trunnion engaging position.

10. Apparatus according to claim 6 and a trunnion engaging wing on each of said mechanisms for guiding a container into centered position between said mechanisms as the container is moved into place for engagement of its trunnions by the trunnion jaws.

11. In a rear loader refuse truck having a loading hopper with side wall structures defining an opening into said hopper, an apparatus for dumping refuse from open-topped containers having outwardly-extending, co-axial trunnions at their upper front corners, said apparatus consisting of a. a left side mechanism mounted on the rear of the left side one of said structures, b. a right side mechanism mounted on the rear of the right side one of said structures, said mechanism otherwise being identical and each comprising, 1. a main lever pivotally mounted on said structure for swinging movement rearwardly and upwardly between a generally vertical rest position with the lower end thereof below the pivot point line and an upper position, 2. an upper trunnion jaw fixedly mounted on said main lever at a level above the level of container trunnions, 3. a lower trunnion jaw mounted on said main lever for vertical sliding movement relative thereto between a rest position at a level below the level of container trunnions and a upper position coacting with said upper jaw for grasping a container trunnion between said jaws, 4. a slot in said main lever, at least the upper end thereof being spaced rearwardly from the pivot line for said lever when said lever is at rest position, the length of said slot in a vertical direction being equal to the extent of vertical movement of said lower jaw relative to said main lever, 5. an hydraulic cylinder pivotally mounted at its upper end on said structure, 6. a cylinder rod extending downwardly from said cylinder, 7. a pin on the lower end of said rod, said pin extending through the slot in said main lever and into said lower jaw, and c. a cross bar connected to and between the lower ends of said main levers.

12. A rear loader truck according to claim 11 in which the slots in the main levers have rearwardly extending short branches into which the pins on the cylinder rods move after the trunnion jaws engage container trunnions for tilting the lower jaws relative to the upper jaws for locking the trunnions therebetween.

13. A rear loader truck according to claim 11 in which each mechanism also comprises a container catch bar that is moved into position above but spaced from the upper edge of the side wall of a container when the trunnion jaws close and which prevent a container from falling forwardly into the hopper when the container is inverted for dumping.

* * * * *